US009518759B2

(12) United States Patent
Butler

(10) Patent No.: US 9,518,759 B2
(45) Date of Patent: Dec. 13, 2016

(54) PHOTOVOLTAIC DC HEATER SYSTEMS

(71) Applicant: Barry Lynn Butler, Solana Beach, CA (US)

(72) Inventor: Barry Lynn Butler, Solana Beach, CA (US)

( * ) Notice: Subject to any disclaimer, the term of this patent is extended or adjusted under 35 U.S.C. 154(b) by 116 days.

(21) Appl. No.: 14/051,383

(22) Filed: Oct. 10, 2013

(65) Prior Publication Data

US 2015/0104160 A1 Apr. 16, 2015

(51) Int. Cl.

| | |
|---|---|
| ***F24H 1/20*** | (2006.01) |
| ***H05B 3/82*** | (2006.01) |
| ***F24H 9/20*** | (2006.01) |
| ***F24H 9/00*** | (2006.01) |

(52) U.S. Cl.

CPC ..... *F24H 1/201* (2013.01); *F24H 1/202* (2013.01); *F24H 9/0021* (2013.01); *F24H 9/2021* (2013.01); *H05B 3/82* (2013.01); *F24H 2240/09* (2013.01); *F24H 2250/02* (2013.01)

(58) Field of Classification Search

CPC F24D 2200/02; F24D 2200/14; F24D 11/003; F24D 19/1057; F24D 19/1075; Y02B 10/20; H05B 3/82

USPC ..... 392/451, 453

See application file for complete search history.

(56) References Cited

U.S. PATENT DOCUMENTS

| | | | | |
|---|---|---|---|---|
| 5,293,447 | A * | 3/1994 | Fanney et al. | 392/449 |
| 8,478,116 | B2 * | 7/2013 | Henry et al. | 392/453 |
| 9,002,185 | B2 * | 4/2015 | Kreutzman | 392/441 |
| 2005/0139344 | A1 * | 6/2005 | Butler | 165/46 |
| 2009/0188486 | A1 * | 7/2009 | Thomasson | 126/585 |
| 2009/0214195 | A1 * | 8/2009 | Thomasson | 392/451 |
| 2014/0153913 | A1 * | 6/2014 | Newman et al. | 392/451 |
| 2014/0263282 | A1 * | 9/2014 | Riley et al. | 219/546 |
| 2014/0265573 | A1 * | 9/2014 | Kreutzman | 307/31 |

* cited by examiner

*Primary Examiner* — Joshua Kennedy

(57) ABSTRACT

Direct current solar electric heating elements can be powered by an array of photovoltaic panels. The direct current voltage can be low or high with proper electrocution protection. Insertable immersion heating elements can be placed into any existing, gas, propane or electric hot water tank, cooking pot or hot tub. Heating elements in air can also be used for heating ovens, range cook tops and sauna heaters. The output of the photovoltaic panel is interfaced to the electric heater element via either direct connection or using a load-matching controller which maximizes the power delivered to the heater under all sun conditions. The maximum heater temperature is regulated by a thermostat.

4 Claims, 5 Drawing Sheets

PHOTOVOLTAIC DC HEATER SYSTEMS

BACKGROUND OF INVENTION

Typical solar hot water heating systems for domestic hot water, hot tubs, water pasteurization and home heating use thermal collectors which are about 65% efficient converting solar energy to heat in water. This is more than photovoltaic panels, which are only about 15% efficient in converting sunlight into heat delivered to the water. The size of the photovoltaic array is about four times larger, but due to recent photovoltaic cost reductions, the cost of the resulting heat delivered to the tank is coming close to the cost of thermal panels. Solar thermal hot water systems need piping to get the solar heated fluid from the solar collectors on the roof to the hot water tank heat exchanger, which limits the temperature of use to about 250° F. A pump must be used to circulate the fluid. These fluid lines must be sloped to drain out fluid when the pump shuts off for drainback systems and should be routed to eliminate high spots that can trap air in glycol-filled systems. The photovoltaic-powered heater system needs only a power cable from the panels to the immersion heater for heating water, or to an air heater to cook food via baking, boiling or frying. The electric heating elements are capable of reaching 800° F., allowing them to be range burners or oven heaters. These high temperature elements are also used in saunas and many other appliances including space heating. The electric power cable can follow the most convenient route, without constraints of fluid-filled lines. Electric wires are not subject to fluid leaks, as are pipes or hoses. The photovoltaic panels can be directly connected to the heating element. With the photovoltaic panels directly connected to the heater, the heater will experience maximum power at noon. At lower insolation levels in the morning and afternoon, the power to the heater will fall off. With the use of a load-matching controller between the photovoltaic panels and the heater, more power can be delivered in the morning and afternoon. Proper electrical component insulation eliminates the potential for shock or electrocution hazards. Measuring the amount of heat delivered by the photovoltaic panels to the heating element can be accomplished with a simple power meter measuring voltage and current. To measure the amount of heat delivered by fluid systems one needs to measure temperatures to and from the collectors and the mass flow of the fluid. Low system cost and ease of installation makes photovoltaic-powered resistance solar water and air heater systems an attractive option to reduce the cost of purchased gas, propane or electricity while being able to keep water hot and cook food year-round. Solar photovoltaic-powered range burners and ovens can be a way to avoid burning wood or coal or other fossil fuels to cook food.

SUMMARY OF INVENTION

In summary, the present invention is a family of photovoltaic-powered air and liquid resistance heater systems. The solar panels are lightweight and easy to mount on a nearby roof, patio cover, or on the ground convenient to the location of the resistance heater. The immersion heater installation into hot water tanks is made simple, since the insertable heater element is simply screwed into the existing hot water tank. This immersion heater can be inserted into conventional hot water storage tanks with natural gas, propane, or electric heating elements. The key to this system is the immersion heater, which screws into the hot water tank and is a single or double wall heat exchanger. A resistive heating element is placed in the central compartment. Heat is transferred from the resistive heating element to the wall using conduction through an insulating ceramic powder or air convection, or the space is filled with non-flammable mineral oil to allow for liquid convection. The heat is then conducted through the wall or walls, where it is in contact with the water in the hot water tank. Natural convection in the water tank cools the heater which heats and stratifies the tank water. An electric cable connects the photovoltaic panels to the load-matching controller which maximizes the power delivered to the immersed heating element. The immersion heater can be connected directly to the photovoltaic panels with a thermostat or through a power maximizing impedance-matching controller designed to accommodate additional photovoltaic power so that more panels can be added to increase the amount of heat provided by solar. To prevent overheating, the immersion heater will disconnect from the photovoltaic panels if the water tank top temperature exceeds 165° F.-185° F. The only adjustment necessary for the water tank heating system is to turn down the electric or gas thermostat to the 120° F. warm temperature range. On most sunny days no power from the back up heater will be needed; during cloudy periods the backup hot water thermostat will keep the water warm. This energy-saving solar hot water heating system can offset much of its cost by reducing the amount of purchased energy needed s to heat the hot water. A major advantage of photovoltaic-powered hot water systems over fluid loop thermal systems is that there is no fluid to leak, overheat or freeze. This makes the photovoltaic systems more reliable and should need fewer repairs.

The photovoltaic panels can also be directly connected to air heaters. These heaters are very similar to electric range burner and Calrod™ type oven heaters. The main difference is that they are powered by DC current coming from the photovoltaic panels. These heaters can reach 800° F., which allows air to conduct the heat away from the heaters and warm an oven or the bottom of a pan or pot. The photovoltaic panels can be directly connected to the air heaters via a thermostat to control temperature, or connected using an impedance-matching power maximizer to increase the power in the morning and afternoon. In many parts of the world a simple affordable way to cook food without harvesting and burning wood or coal can be provided with photovoltaic-powered air heating elements.

PRIOR ART

The most common electric hot water heaters use high voltage electric heating elements immersed in a tank that are connected to an electric grid power source. These tank heaters are powered by 120-240 VAC and keep the hot water tank warm and ready to use. The power to run these heaters is drawn from the local power grid in most cases. A typical hot water tank uses two 2,000 W heaters which can rapidly heat the water in the storage tank for use, and rapidly reheat the tank when a lot of hot water is used. Prior patents on this subject show the photovoltaic panel connected to an inverter, which takes the low photovoltaic panel voltage and converts it to 120-240 VAC. This power is then used to power conventional hot water tank heating elements. Those systems cannot be adapted to gas or propane hot water tanks. And, to replace a gas or propane hot water tank with an electric hot water heater requires that a new high-power electric circuit be brought to the tank's location from the house power panel at significant cost and effort.

Photovoltaic direct current water heating system patents recite adding and removing resistive elements using relays to change the resistance of the heater elements to match the peak power being produced by the solar panels. High resistance in the morning is incrementally switched to low resistance at noon and then incrementally back to high resistance in the late afternoon. That system is complicated and needs a number of different resistance heaters connected to relays to achieve this variable resistance.

Solar thermal hot water heating systems use liquid heated in a solar collector to heat a heat exchanger built into or screwed into the existing hot water storage tank. The liquid-based screw-in heat exchanger is the subject of an existing patent issued to one of the current inventors. Solar thermal systems are more efficient, taking up less roof area than photovoltaic systems, but the fluid loop must have pumps and connections. In addition, the heat transfer fluid needs to be protected from freezing and overheating.

The primary objective of the present invention is to use solar photovoltaic panels to provide heat directly and safely to a hot water tank and save 40% to 60% of the cost of purchased gas, propane or electricity. Another objective is to use direct current to power air heaters to bake, broil and fry food and perform other tasks commonly done by air heaters, like space heating and sauna heating. Another objective is to reduce the time and complexity of retrofitting solar energy to existing hot water tanks by allowing for simple installation of the heating element in the tank wiring from the solar collector to the hot water tank. For gas and propane water heaters there is no need for a new grid-connected power circuit and disconnect box. Photovoltaic panels connected to cooking and heating appliances either directly or through an impedance-matching circuit allows for many solar powered cooking and heating applications. The objectives and advantages of the invention may be realized and attained by means of the instrumentalities and combinations particularly pointed out in the appended claims.

DETAILED DESCRIPTION OF THE PREFERRED EMBODIMENT

Figure 1:
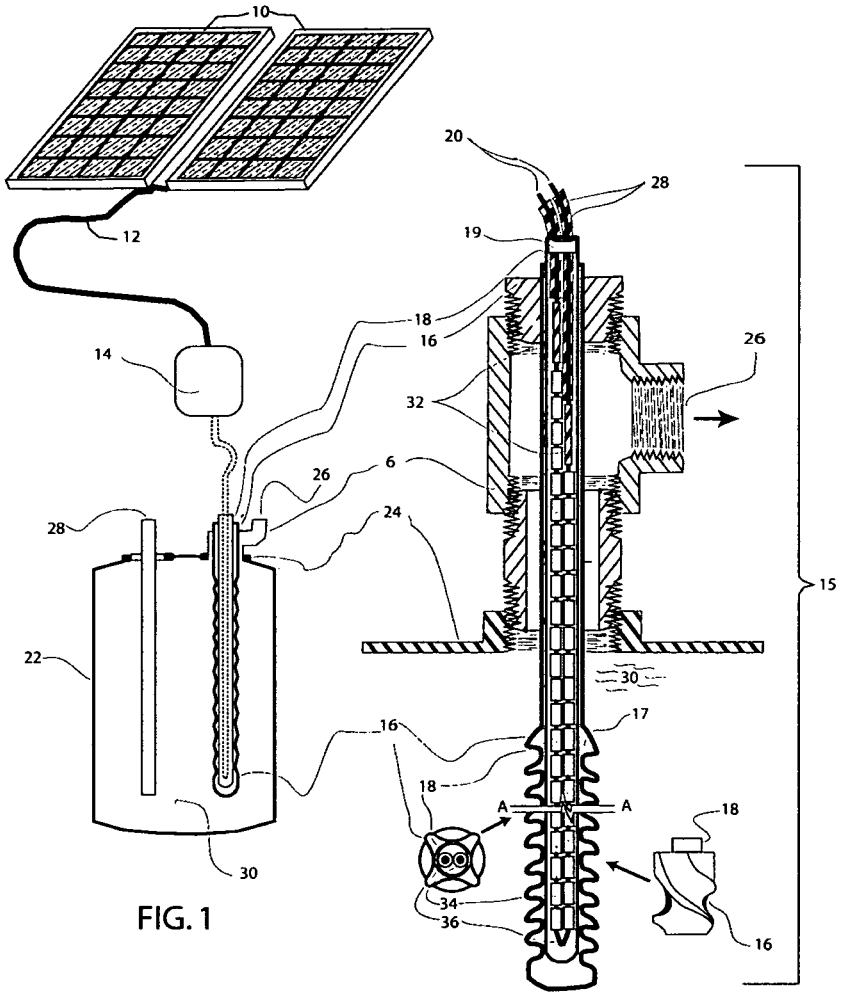
FIG. 1 is a perspective view of the photovoltaic hybrid hot water double wall immersion heater system.

The invention consists of a solar photovoltaic-powered hot water heating system shown in FIG. 1. The heart of the system is an immersion heater (15) which is shown powered by the photovoltaic panels (10) through a power cable (12). The hot water tank (22) is full of water (30) and has a cold water inlet (28). The power cable (12) from the photovoltaic panels (10) is connected to the power maximizing box (14). The impedance matching power maximizer box (14) can be eliminated and wire (12) can be directly connected to resistance heater using wires (20). The power maximizing box is connected to the immersion heater element (15) through wires (20). These lead wires (20) are insulated with high temperature insulation (28) and are connected to the resistive heater wire (36) by connectors (32). The resistive heating wire (36) is insulated with ceramic insulators (34) or packed ceramic powder insulation to keep it from making electrical contact with the metal tube wall (18). This electrically-heated inner tube (18) is physically in contact with the outer tube (16) which is in contact with the water to be heated. The immersion heater (15) can be inserted into any existing hot water tank port (4) since it has provisions to allow water to enter or exit the tank (26) via a plumbing fitting (6). Heated water (30) can come out through the fitting (6) and be replaced with cold water entering the tank through tube (28) so it is directed to the bottom of the hot water tank (22).

A double-wall isolation immersion heater (15) is shown in FIG. 1. It is threaded into the hot water tank port (24), so that water can enter or exit the tank (26) via fitting (6). The heater element is encased in two walls: inner (18) and outer (16). These walls are in mechanical contact with a space between them (17) which is vented outside of tank fitting (6). Hence, if liquid leaks through the outer wall (16) it will flow into space (17) and out the top of fitting (6). This protects the heating elements (28, 32, 34 and 36) inside tube (18) from contact with water (30). The heating elements (28, 32, 34 and 36) inside tube (18) are sealed with an atmospheric moisture seal (19) which may be made using a potting resin. The heating elements (28, 32, 34 and 36) inside tube (18) may be encased in insulating ceramics or ceramic powder (34) or immersed in mineral spirits or a similar insulating non-flammable fluid.

Figure 2:
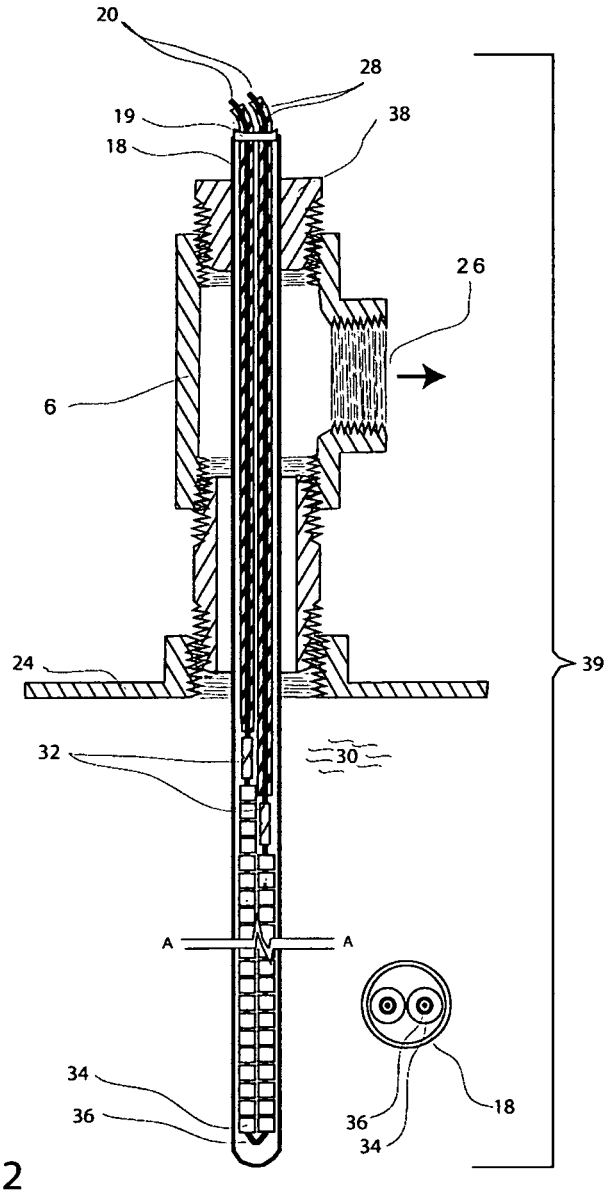
FIG. 2 is a perspective view of a single wall immersion heater in a water tank.

A single-wall isolation immersion heater (39) is shown in FIG. 2. It is threaded into the hot water tank port (24), so that water can enter or exit the tank (26) via a plumbing fitting (6). The heater element is encased in one wall (18). Hence, if liquid leaks through the wall (18) it will flow into the space occupied by the heating elements (28, 32, 34 and 36) inside tube (18) and the unit will need to be replaced. The heating elements (28, 32, 34 and 36) inside tube (18) are sealed with an atmospheric moisture seal (19) which may be made using a potting resin. The heating elements (28, 32, 34 and 36) inside tube (18) may be encased in insulating ceramics or ceramic powder (34) or immersed in mineral spirits or a similar insulating non-flammable fluid.

Figure 3:
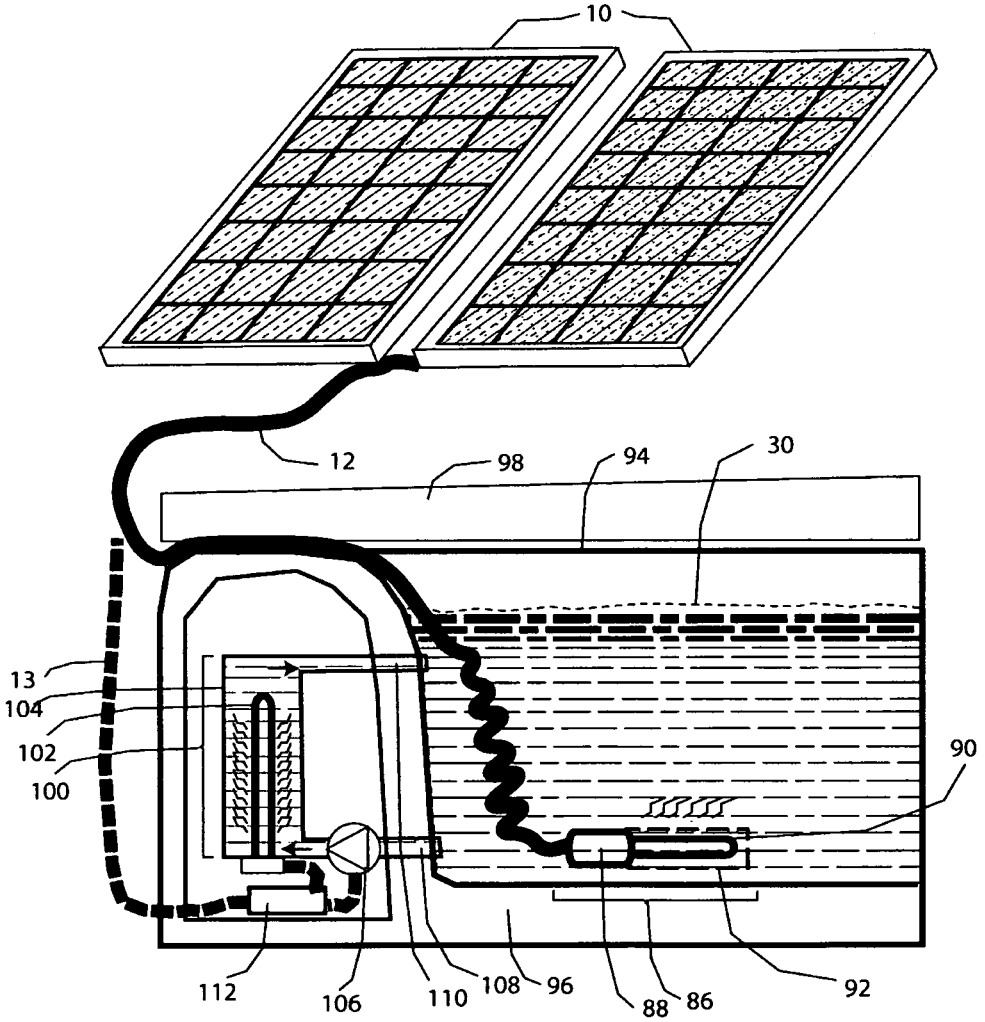
FIG. 3 is a perspective view of a single wall immersion heater in a hot tub.
Figure 4:
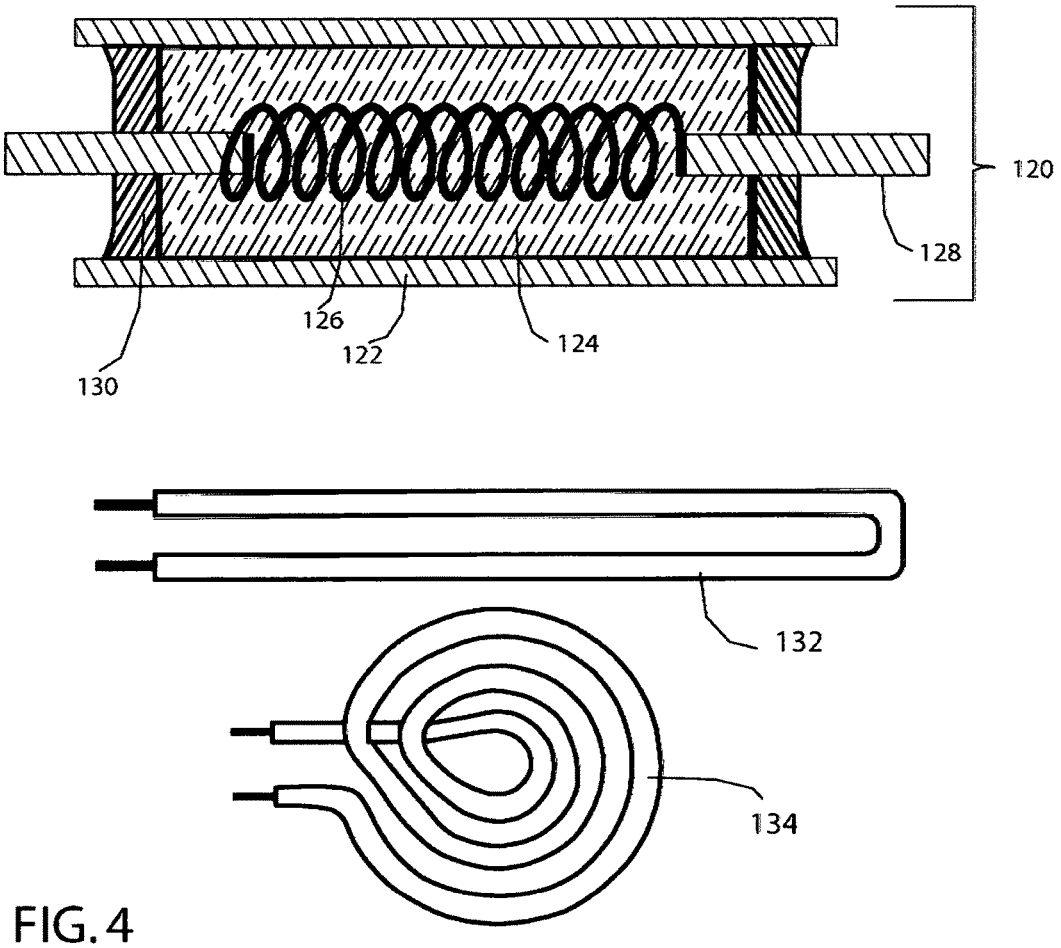
FIG. 4 is a perspective view of a range and oven heater.

A single-wall isolation immersion water heater (86) is shown in FIG. 3. The hot tub (96) contains water (30). The rim of the hot tub (94) and cover (98) create a small gap where the flexible cable (12) from the photovoltaic panels (10) enters the hot tub and goes to heater (86). The heater (86) is comprised of a waterproof body holding the electrical connections and thermostat (88), either direct or through an impedance-matching circuit, a resistive heating element (90) and a protective metal cage (92). Hence, if liquid leaks through the resistive element (90) outer wall it will flow into the space occupied by the heating elements inside tube heating element (90) and the unit will need to be replaced. The heating elements' internal configuration is shown in FIG. 4. The protective metal cage (92) keeps people in the hot tub from coming in contact with the heater element (90) while immersed. The protective metal cage (92) also protects the heating element (90) from coming in contact with flammable materials, when taken out of the water. An alternative method of hot tub (96) heating is shown in FIG. 3; it uses a tank type heater (100), which is connected to photovoltaic panels (10) via flexible cable (13). The tank (104) contains a resistive heating element (102); when the sun is out, water is pumped (106) from the bottom of the hot tub (96) in pipe (108) past heater element (102) and returned to the top of the hot tub (96) in pipe (110). The heater (102)

and pump (106) are both controlled by the control box (112). This box (112) contains the impedance-matching circuit for photovoltaic panels (10) to heater (102) and the thermostat and pump on/off control circuits.

Air resistance heating elements are shown in FIG. 4. The direct current heating element (120) is comprised of a high temperature corrosion resistant tube of stainless steel or nickel based super alloy steel (122); a resistive heating element, typically Nichrome-C wire (126); a high current lead (128); ceramic insulating material, typically a powder; and end seals of glass or ceramic or high temperature polymer (130). This complete heating element (120) can be bent with metal forming tools into many useful shapes. The U-shape heaters (132) are used for ovens and other air heaters. The coil shape heaters (134) are used for range cook tops for boiling, frying and grilling food, and many other pot and pan heating applications.

Figure 5:
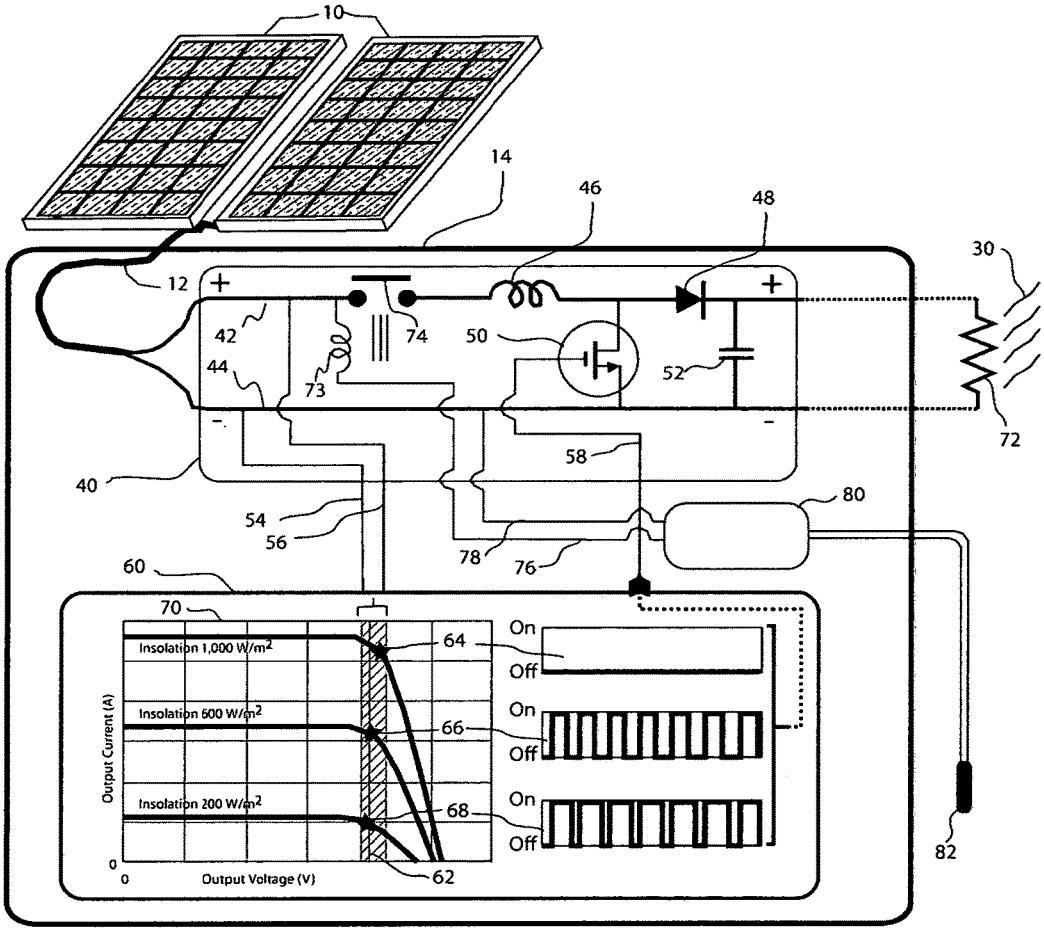
FIG. 5 is a diagram of the electrical control system that maximizes the solar power delivered to the fixed resistance immersion heater and provides over temperature protection.

An electronic schematic of one embodiment of a power maximizing circuit is shown in FIG. 5. It shows an electrical control system that maximizes the direct current solar power delivered to the fixed resistance immersion heater and provides over-temperature protection to shut off power to the heater if the tank is overheating. As indicated in the figure, the maximum power point of the photovoltaic array occurs within a narrow band of voltage over a range of solar insolation levels. The control system does pulse-width modulation to keep the photovoltaic voltage within that range. The power from the photovoltaic panel (10) arrives at the power maximizing box (14) via cable (12). Power is inductively stored in coil (46) when transistor (50) is turned on. When transistor (50) is turned off power in line (42) passes through diode (48) and powers both resistive element (72) and capacitor (52). The resistive heater then heats the water (30). Current returns to the photovoltaic panel via line (44).

The transistor (50) is turned on and off by a low voltage on/off signal sent on line (58). This signal is generated in the pulse width modulator control box (60). The photovoltaic panel voltage is fed into the modulator control box (60) via lines (54 & 56). Using the logic shown on graph (70) the solar panel peak power point is approximated and the transistor (50) turned on and off by the modulator control box (60). Under high solar insolation levels, peak power (64) keeps the transistor (50) off. This allows the solar power to charge the capacitor (52) and power the resistive heater (72). Under medium solar insolation levels, peak power (66) turns the transistor (50) on and off rapidly. The transistor (50) spends about half the time turned on and half the time turned off. When the transistor (50) is on, the power is stored in inductor (46); when the transistor (50) turns off, the power stored in the inductor (46) combines with power from the photovoltaic panel and passes through diode (48) to supply constant voltage to the capacitor (52) and resistive heater (72) for short durations. When the transistor (50) is turned on, the energy stored in capacitor (52) discharges through resistive heater (72), powering it. Under low solar insolation levels, peak power (68) keeps the transistor (50) mostly on with short off periods. This on/off modulation of the transistor (50) keeps a string of high voltage pulses from both the capacitor (52) and inductor (46) moving into the resistive heating element (72).

The tank over-temperature control system shuts off the power to the resistive load (72) by interrupting line (42) with a contactor (74). The contactor (74) is energized by a coil (73) which is powered by the photovoltaic panel through lines (76 & 78), which connect to control box (80), which powers the coil when the temperature from the tank sensor (82) is below the over-temperature set point. If the tank sensor (82) indicates a temperature above the set point, the control box (80) will turn off power to the contactor coil (74) and this will break line (42) turning off power to the resistive heater (72). Other circuit configurations can also be used to accomplish the same results, including circuits with microprocessors that actively adjust the pulse-width modulation based on the photovoltaic panel voltage.

What is claimed is:

1. A photovoltaic powered electric water heater for use with a pressurized hot water tank or unpressurized water tanks or open containers, comprising:

a double wall isolation immersion heater, the immersion heater comprising:

inner and outer walls having mechanical contact with a space between them;

a threaded plumbing fitting such that the immersion heating element is configured to be threaded to the tank, the outer wall being mounted to the plumbing fitting such that the space is vented outside of the fitting;

an immersion resistance heating element being encased within the inner wall such that the inner and outer walls space the heating element from an interior of the tank; the heating element further comprising:

internal resistance heating wires and lead in wires sealed within said inner wall and insulated by being encased in solid or powdered ceramic materials or by being immersed in mineral oil;

solar photovoltaic panels wired to power the immersion resistance heating element such that the heater resistance is configured to match DC power produced by the panels without the use of impedance matching circuitry;

the power wiring is directly connected through one open end to the immersion resistance heating element through only an independent temperature sensor activated switch.

2. A heater system according to claim 1, wherein the lead in wires and resistance heater are within the inner wall made of a single metal corrosion-resistant sheath of copper, stainless steel or monel with the power lead in wires exiting the fitting on a single end, the inner sheath assembly being placed into the outer wall made of a second outer sheath assembly placed into a second outer sheath wall of metal or polymer where the conduction of heat between these two walls is by intimate contact or filling the space with non-flammable oil, so perforation of the outermost wall will cause fluid, water or oil, trapped between the walls to be visibly discharged outside of the water storage tank creating a positive indication that the units outer wall has failed while the inner wall keeps the electric elements free of fluid intrusion.

3. A heater system according to claim 1 where the immersion straight chromalloy wire resistance elements surrounded by said ceramic electrical insulating material and/or said insulating oil, all within the inner wall; the inner wall being a liquid corrosion-resistant metal sheath.

4. A heater system according to claim 1 where the immersion resistance heating element is immersed in air and uses coiled or straight chromalloy wire resistance elements surrounded by said ceramic electrical insulating material all within the inner wall; the inner wall being a high temperature air corrosion-resistant single metal sheath, where the heat is transmitted to said outer wall by metal to metal conduction and/or air convection.

* * * * *